United States Patent [19]

Debaigt

[11] 4,220,392

[45] Sep. 2, 1980

[54] TERMINAL BLOCK FOR GROUND CONDUCTORS

[75] Inventor: Jean Debaigt, Maisons Laffitte, France

[73] Assignee: Société Anonyme dite: CGEE ALSTHOM, Levallois Perret, France

[21] Appl. No.: 6,160

[22] Filed: Jan. 24, 1979

[30] Foreign Application Priority Data

Feb. 7, 1978 [FR] France ..... 78 03344

[51] Int. Cl.[3] ..... H01R 7/18; H01R 9/18

[52] U.S. Cl. ..... 339/198 N; 339/263 L

[58] Field of Search ..... 339/253 R, 254 R, 254 M, 339/255 R, 255 L, 14 R, 14 L, 272 R, 272 A, 196 M, 198 R, 198 N, 263 L

[56] References Cited

U.S. PATENT DOCUMENTS

| | | | |
|---|---|---|---|
| 1,943,590 | 1/1934 | Douglas | 339/254 R |
| 2,748,365 | 5/1956 | Speck | 339/198 N |
| 3,086,191 | 4/1963 | Olashaw | 339/255 R X |
| 3,778,748 | 12/1973 | Holman | 339/196 M X |

FOREIGN PATENT DOCUMENTS

| | | | |
|---|---|---|---|
| 1415131 | 10/1968 | Fed. Rep. of Germany | 339/254 R |

*Primary Examiner*—Roy Lake
*Assistant Examiner*—Eugene F. Desmond
*Attorney, Agent, or Firm*—Sughrue, Rothwell, Mion, Zinn and Macpeak

[57] ABSTRACT

A terminal block for ground conductors, includes, in an insulating casing, a tunnel type connector with contact shoes which co-operate with the edges of a metal section bar for supporting said terminal block. The connector is formed in two parts (5,5') each of which includes a longitudinal flat portion (7,7') disposed against the like portion of the other part and each flat portion including a part of contact shoes (8,8'), the contact shoe of one flat portion being associated with the contact shoe of the other flat portion, said parts being assembled together by crimping the flat portions.

3 Claims, 5 Drawing Figures

TERMINAL BLOCK FOR GROUND CONDUCTORS

FIELD OF THE INVENTION

The invention relates to a terminal block for ground conductors. The terminal block is suitable for use in a connection strip which is supported by a section bar which acts as a main earth conductor for grounding electrical equipment connected to the connection strip.

BACKGROUND OF THE INVENTION

Earthing terminal blocks frequently include a wire-clamping tunnel type connector for connection to equipment ground wires and contact shoes for contact with the supporting section bar. Equipment ground wires can then easily be inserted in the tunnel which passes through the terminal block, while the contact shoes are clamped against the edges of the supporting section bar to provide the required ground connection.

The tunnel-type connector is generally formed by two parts each of which includes a flat portion with contact shoes, said parts being assembled by welding together or by screwing together the flat portions which support the contact shoes. Now, such modes of assembly are neither very rapid nor reliable, as welds can break and connection by screws can be precarious.

The invention aims to provide a grounding terminal block which can be easily and rapidly manufactured and which is reliable while having a competitive cost price.

The invention provides an grounding terminal block for ground conductors, said terminal block including, in an insulating casing, a tunnel type connector with contact shoes which co-operate with the edges of a metal section bar for supporting said terminal block. The improvement ties in the connector being formed in two parts, each of which includes a longitudinal flat portion disposed against the like portion of the other part and each flat portion includes a pair of contact shoes. The contact shoe of one flat portion is associated with the contact shoe of the other flat portion, said parts being assembled together by crimping the flat portions.

It will be appreciated that the term "ground" is used herein in its usual sense for electrical circuits, i.e. to designate a conducting body of large extent relative to the "live" conductors of an electrical circuit and serving as a protection against the remainder of the electrical equipment becoming accidentally live. Such a conducting body e.g. the chassis of a vehicle, need not necessarily be in direct electrical connection with the ground.

Embodiments of the invention are described, by way of example, with reference to the accompanying drawings.

DESCRIPTION OF PREFERRED EMBODIMENTS

Figure 2:
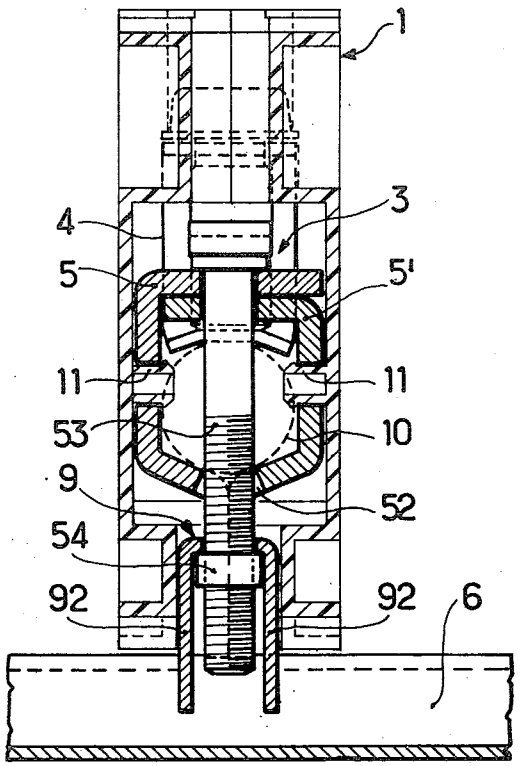
FIG. 2 is a cross-section along line II—II of the terminal block of FIG. 1.
Figure 1:
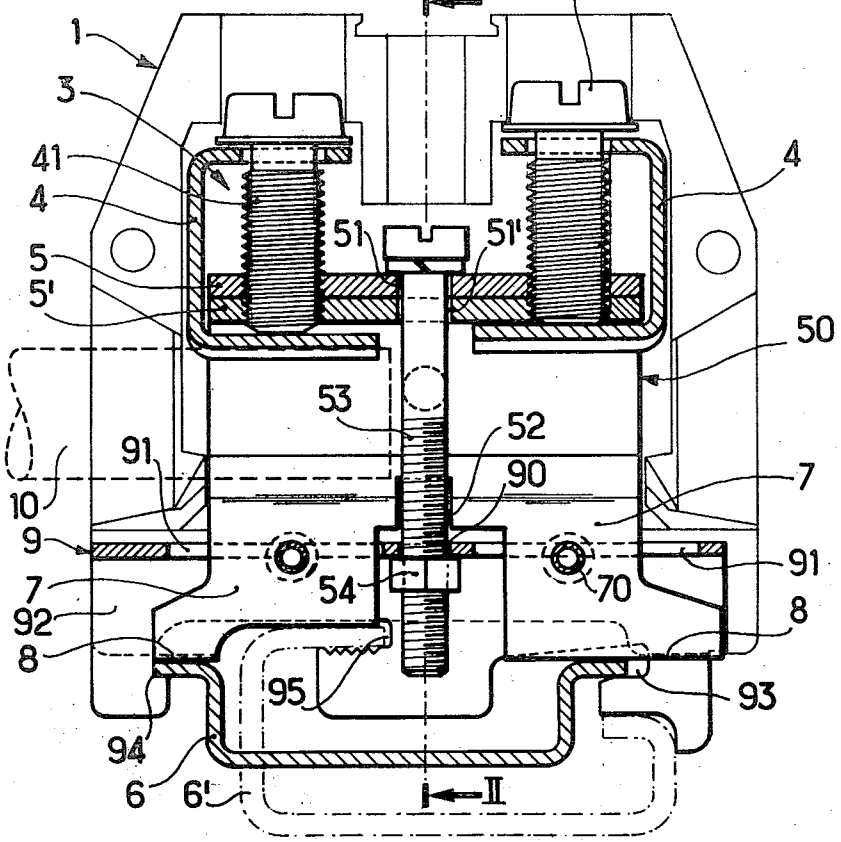
FIG. 1 is a longitudinal cross-section of a terminal block.

In FIGS. 1 and 2, two half-shells 1 constitute the insulating casing of a terminal block having a conductor 3 which includes two screw terminals 4 for clamping wires in a tunnel type connector 50.

Since the terminal block is intended to connect grounding wires 10 to a main ground connection constituted by a section bar 6 which supports the terminal block, the connector 50 includes, at its base, two contact shoes 8 and 8' for contact with the upper edges of the supporting bar 6 which has outwardly-turned edges.

Figure 3:
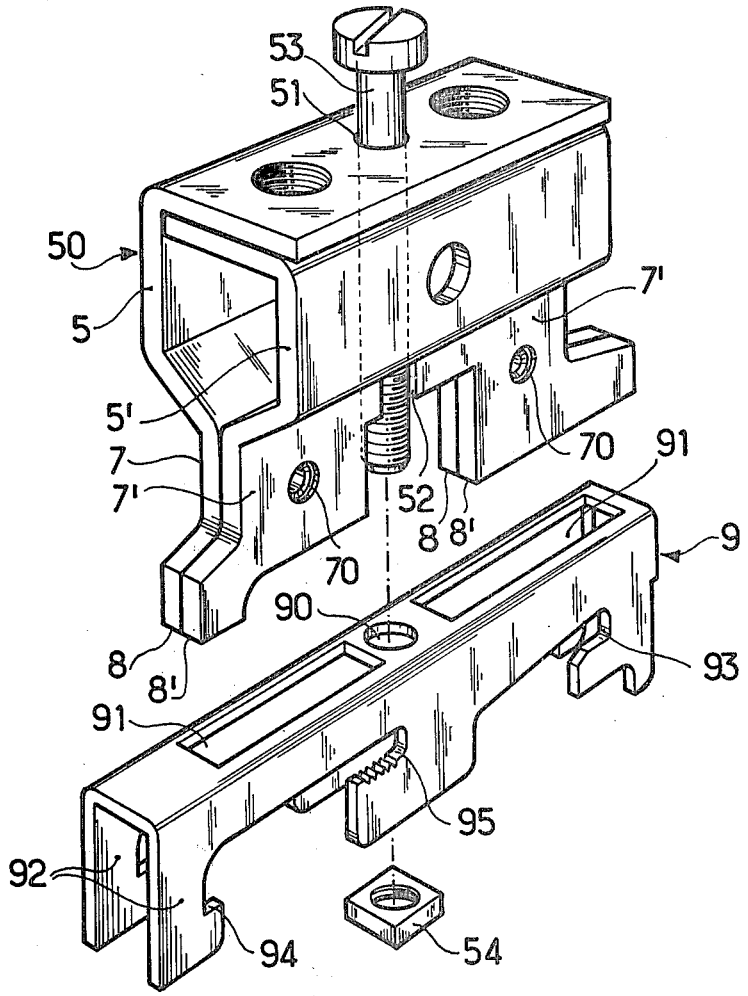
FIG. 3 is an exploded view of the wire-clamping connector of FIG. 1.

The tunnel type connector 50 is made in two parts—a left-hand part 5 and a right-hand part 5'—which can be seen more particularly in FIGS. 2 and 3. Each of these two parts includes an upper mounting plate, the two mounting plates being disposed one on the other. A pair of threaded holes for engaging screws 41 of the terminals 4 are disposed in the mounting plates on either side of a smooth-bore central hole designated 51 and 51' for the respective parts 5 and 5'.

Each part has a side plate with a hole in it and through which passes a lug 11 for resilient fixing to the adjacent half-shell. At the lower portion of the connector and in its longitudinal axis, on either side of a central recess 52 through which a clamping screw 53 passes, each of the parts 5 and 5' further includes a flat vertical portion (7 for the left-hand part 5 and 7' for the right-hand part 5').

Each of the back-to-back flat portions 7 and 7' supports contact shoes 8 and 8' which are also back-to-back.

The flat portions 7 and 7' are crimped together. For this purpose, the flat portions 7 of the parts 5 include, at their centre, a reinforcing ring 70 which is crimped in a chamfered hole 70' of the associated part 5'.

To allow clamping against the upper edges of the supporting section bar, the contact shoes 8 and 8' co-operate with an E-shaped clamping clip 9 which, for this purpose, has, on its base, on either side of a central hole 90, openings 91 through which the contact shoes are inserted between side plates 92 of the clip 9.

The side plates 92 have projections with notches 93 and 94 for receiving the edges of the supporting section bar 6. The lower rims of the notches 93 and 94 are clamped under the edges of the section bar 6 whose upper edges are then wedged against the shoes 8 and 8', by means of a screw 53 which is threaded through the holes 51 and 51' with the head of said screw resting against the upper mounting plate of a nut 54 disposed in the recess between the side plates 92 and against the base of the clip 9. The ground conductor 10 is thus easily connected by means of the connector 50 to the main ground conductor constituted by the support rail 6.

Figure 4:
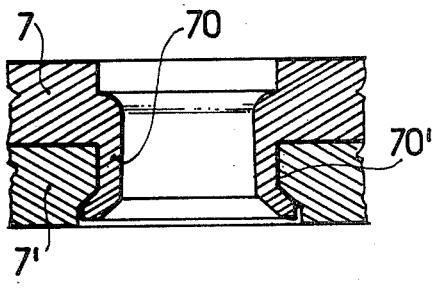
FIG. 4 is a detailed view of the configuration of the component parts of the wire-clamping connector of FIG. 1.

FIG. 4 illustrates in detail on an enlarged scale the configuration of the connector 50, the two parts 5 and 5' being crimped together in a particularly advantageous, rapid, economic and reliable operation to form this configuration.

Figure 5:
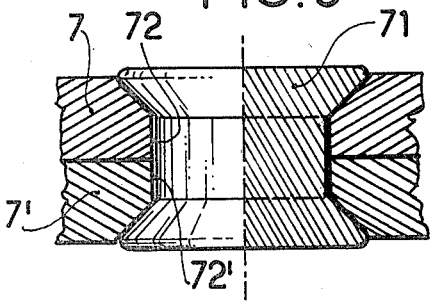
FIG. 5 is a detailed view of a variant of the configuration of the component parts of the wire-clamping connector.

The embodiment illustrated in FIG. 5 shows a variant in the assembly of the flat portions 7 and 7' of the parts 5 and 5' which constitute the connector 50. In the variant, the flat portions 7 and 7' are assembled by crimping a rivet 71 in chamfered holes 72 and 72'.

It is evident that the invention is in no way limited to the embodiment which has just been described and illustrated and which has been given only by way of example; in particular, as shown in dashed lines in FIG. 1 a variant supporting section bar 6' which has inwardly-turned parallel edges can support the terminal block described by means of a third notch 95 formed in a projection from the central part of two side plates 92.

I claim:

1. A ground conductor terminal block for grounding a conductor to a metal section bar, said bar including laterally opposed edges, said terminal block including an insulating housing, a tunnel type connector within said housing, said connector including contact shoes for overlying contact with said bar at said edges, a clamping clip for engaging said bar on the side of said bar opposite said contact shoes, and bolt and nut means for engaging said connector to said clamping clip to lock said connector and said clip to said bar, the improvement wherein:

said clip is of inverted U-shaped cross-section and including a base, longitudinally spaced slots within said base, said U-shaped cross-section clip further including at least two projections remote from said base and bearing notches such that the clip engages the opposite side of said metal section bar at said edges, said connector being formed in two parts each of which includes a longitudinal flat portion, said flat portions being disposed against each other, each flat portion including a pair of contact shoe portions, which define said contact shoes, the contact shoe of one flat portion being in juxtaposition with the contact shoe of the other flat portion, said contact shoes projecting through respective slots within the base of said clip, and said parts being crimped together at said flat portions to permit said contact shoes to pass freely through said slots while allowing rapid and reliable mechanical coupling between the longitudinal flat portions of said connector.

2. A terminal block according to claim 1, wherein the parts are assembled by crimping a reinforcing ring of one of the two flat portions around a hole in the other flat portion.

3. A terminal block according to claim 1, wherein each part flat portion bears a hole and the parts are assembled by crimping a rivet through the flat portion holes.

* * * * *